US005901694A

United States Patent [19]

Aydelott

[11] Patent Number: 5,901,694

[45] Date of Patent: May 11, 1999

[54] COUNTERWEIGHT FOR SILICON INGOT ENDCUTS

[75] Inventor: Richard M. Aydelott, Vancouver, Wash.

[73] Assignee: Seh America, Inc., Vancouver, Wash.

[21] Appl. No.: 08/935,197

[22] Filed: Sep. 22, 1997

[51] Int. Cl.[6] ..... B28D 1/02

[52] U.S. Cl. ..... 125/12; 125/13.01; 451/442

[58] Field of Search ..... 125/23.01, 12, 125/13.02, 13.01, 16.02; 451/442; 269/902; 83/459, 452, 458

[56] References Cited

U.S. PATENT DOCUMENTS

| | | | |
|---|---|---|---|
| 4,109,635 | 8/1978 | Rossborough | 125/10 |
| 4,162,593 | 7/1979 | Asmanes | 51/218 |
| 4,633,848 | 1/1987 | Bresciani | 125/21 |
| 4,766,875 | 8/1988 | Feigelson | 125/21 |

*Primary Examiner*—David A. Scherbel
*Assistant Examiner*—Shantese McDonald
*Attorney, Agent, or Firm*—Alston & Bird LLP

[57] ABSTRACT

A counterweight to facilitate endcuts from silicon ingots comprising a bent angle moment arm and adjustable weighting means.

13 Claims, 1 Drawing Sheet

COUNTERWEIGHT FOR SILICON INGOT ENDCUTS

BACKGROUND OF THE INVENTION

The fabrication of semiconductors utilizes wafers of silicon basically comprising thin slices from large cylindrical crystalline ingots. Typically, such ingots must first be machined into the cylindrical shape by grinders, leaving relatively short cone-shaped sections on one end of the cylindrical ingot and a longer, tapered, irregular-shaped tail section. Both the cone and tail sections must first be removed, typically by way of an inner diameter diamond circular saw blade, in order to facilitate further processing of the cylindrical ingot. Because its generally longer taper makes for a greater moment arm, the tail section is readily removable by the saw blade without any problems.

However, as the inner diameter saw blade cuts through the cone-shaped end of the ingot, a vacuum is often produced in the space between the blade and the cone section being removed, due in part to the narrow gap between the planar surface of the saw blade and the cut portion of the wall of the ingot, in part to the greater cross-sectional area being cut, and in part to the extremely-high velocity (ca. 1100 rpm) of the saw blade. The so-created vacuum tends to pull the section of the ingot being cut into the blade, thereby creating a number of problems: friction between the ingot and the saw blade reduces blade life and increases saw downtime; resultant shear stress on the outer portion of the uncut crystal can lead to chips and cracks in the crystal upon completion of the cut, thereby reducing the yield of useable crystalline ingot; and, on occasion, due to the build-up of vacuum between the blade and the section being cut, the entire section being cut will adhere to the spinning blade, the blade then often throwing the cut piece into the mounting assembly of the blade, which in turn results in catastrophic failure of the blade and severe damage to the cut end of the ingot.

The conventional way of dealing with all of the aforesaid problems is to affix a mass of clay or putty to the end of the ingot that is being cut off. However, this method has a number of engineering drawbacks, chief among which is the difficulty of molding the clay or putty into the proper size and shape so that it will not only stick to the end of the ingot being cut off but at the same time provide sufficient moment to eliminate the vacuum yet not so great a moment as to cause the uncut section of the crystalline ingot to break. Another significant drawback with this prior art method comes into play by virtue of the extremely sensitive slicing machine sensors which are very diameter-sensitive; improper placement of the clay or putty can and often does confuse the machine's sensors, resulting in the cut being made at an improper location. Still another draw-back is the safety-related problem comprising imbedment of sharp silicon shards in the putty during cutting which shards tend to cut operator's hands when the putty is removed and/or reattached to a new ingot.

There is therefore a need in the art of making endcuts from silicon ingots for a method or device which will provide an adjustable moment on the section of ingot that is being cut off, the device being securely attachable to that section and being reusable, so as to eliminate the creation of a vacuum and at the same time not generate sufficient downward force to cause premature breakage of the section being cut off from the ingot. These needs and others are met by the present invention, which is summarized and described in detail below.

SUMMARY OF THE INVENTION

The present invention is a counterweight comprising a bent angle moment arm that is attachable to the conical end of an ingot and an adjustable weighting means.

DETAILED DESCRIPTION OF THE INVENTION

Figure 1:
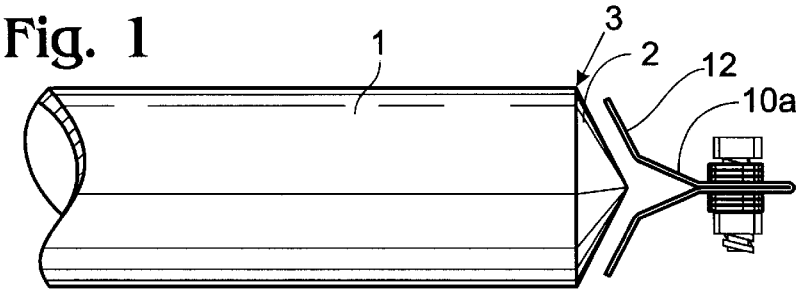
FIGS. 1–3 are side elevations of various exemplary embodiments of the counterweight device of the present invention shown attached to the conical end of a silicon ingot.
Figure 2:
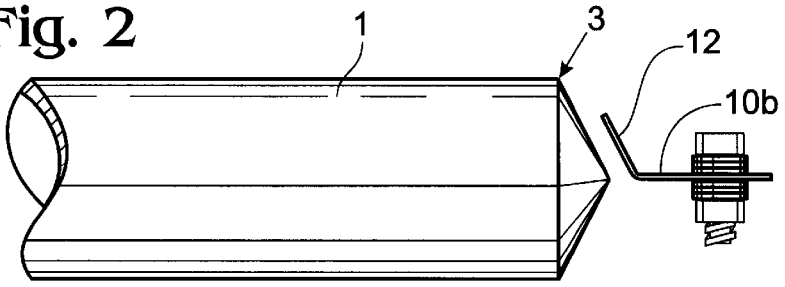
Figure 3:
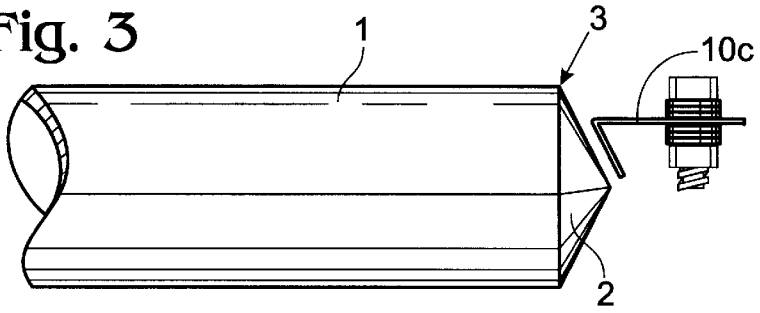

Referring now to the drawings, wherein like numerals refer to the same elements of the invention, there is shown in FIGS. 1–3 a generally cylindrical-shaped silicon ingot 1 having a conical end 2, with a line 3 indicating the cut line. Attached to the ingot 1 is a bent angle moment arm 10 which may contain oblique angles (10*a* and 10*b*) or acute angles (10*c*). The attaching portion 12 of the moment arm 10 preferably has a strip of two-sided adhesive tape attached thereto for securing the moment arm 10 to the conical portion 2 of the ingot; in a most preferred embodiment, the two-sided adhesive tape is removable, thereby permitting easy disengagement from the endcut and reuse of the device.

Figure 4:
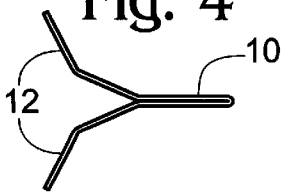
FIG. 4 is a side elevation showing one exemplary embodiment of the present invention.
Figure 5:
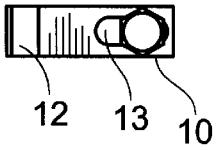
FIG. 5 is a top view of the counterweight lob shown in FIG. 2.
Figure 6:
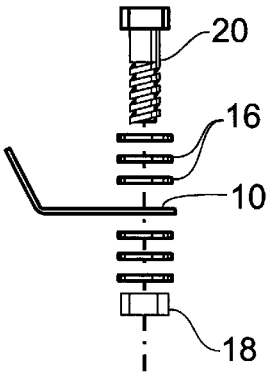
FIG. 6 is an exploded side elevation of the counterweight shown in FIG. 5.
Figure 7:
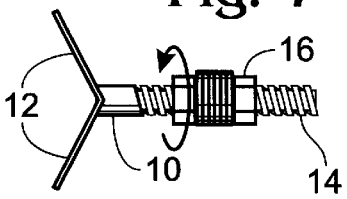
FIGS. 7 and 8 are side elevations of additional exemplary embodiments of the invention.
Figure 8:
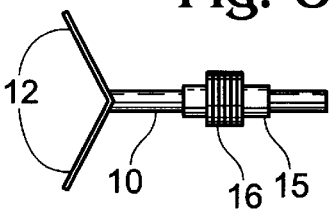

Although FIGS. 4 and 7–8 show Y-shaped moment arms 10 having two attaching portions 12, as shown in FIGS. 5–6, moment arms having single attaching portions 12 are also contemplated by the present invention. The moment arm 10 is provided with a hole or slot 13 or threads 14 (FIG. 7) or elastic tubing 15 (FIG. 8) to provide an adjustable engagement with weights 16 which may be in the form of washers (FIG. 6), lock or jam nuts (FIG. 7) or tube-engaging nuts or washers held in place by friction (FIG. 8). In the case of washers as shown in FIGS. 5 and 6, they are preferably held in place by a fastener comprising, for example, a nut 18 and bolt 20.

In operation, the counterweight is secured to the end of the ingot by affixing the attaching portion 12 of the moment arm 10 to the section to be cut off, weights 16 are secured to moment arm 10 and adjusted so as to provide the proper moment to both prevent formation of a vacuum between the saw blade and the ingot wall and to avoid breakage of the ingot as the cut nears completion.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A counterweight to facilitate cuts from a conical end of a substantially cylindrical ingot comprising:

(a) a bent angle moment arm attachable to said conical end of said ingot, wherein said bent angle moment arm comprises an attaching portion that is bent at an angle relative to other portions of said bent angle moment arm to facilitate attachment of said attaching portion to said conical end of said ingot; and (b) adjustable weighting means attachable to said moment arm.

2. The counterweight of claim 1 wherein said bent angle comprises at least one oblique angle.

3. The counterweight of claim 1 wherein said bent angle is an acute angle.

4. The counterweight of claim 1 wherein said weighting means is slidably adjustable.

5. The counterweight of claim 1 wherein said moment arm comprises a pair of attaching portions for attaching to said conical end of said ingot in two places.

6. The counterweight of claim 1 further comprising adhesive for attaching said moment arm to said conical end of said ingot.

7. The counterweight of claim 6 wherein said adhesive is removable.

8. A method for counterweighting a conical end of an ingot comprising the steps of:

providing a moment arm having an attaching portion and a weighted portion; and adhesively affixing the attaching portion of the moment arm to the conical end of the ingot such that the weighted portion of the moment arm extends outwardly beyond the conical end of the ingot so as to counterweight the conical end of the ingot.

9. A method according to claim 8 further comprising the step of removing the moment arm from the conical end of the ingot once the conical end of the ingot is cut from the remainder of the ingot.

10. A method according to claim 9 further comprising the step of adhesively affixing the removed moment arm upon the conical end of another ingot so as to counterweight the conical end of the other ingot.

11. A method according to claim 8 further comprising the step of weighting the weighted portion of the moment arm, wherein said weighting step comprises mounting weights upon the weighted portion of the moment arm.

12. A method according to claim 11 wherein said mounting step comprises adjusting the weight upon the weighted portion of the moment arm.

13. A method according to claim 8 wherein said providing step comprises providing a moment arm having a pair of attaching portions, and wherein said affixing step comprises adhesively affixing each of the attaching portions to respective portions of the conical end of the ingot.

* * * * *